US006823674B2

(12) United States Patent
Schwarzott

(10) Patent No.: US 6,823,674 B2
(45) Date of Patent: Nov. 30, 2004

(54) METHOD FOR OPERATING A GAS AND STREAM TURBINE INSTALLATION AND CORRESPONDING INSTALLATION

(75) Inventor: Werner Schwarzott, Grossenseebach (DE)

(73) Assignee: Siemens Aktiengesellschaft, Munich (DE)

( * ) Notice: Subject to any disclaimer, the term of this patent is extended or adjusted under 35 U.S.C. 154(b) by 78 days.

(21) Appl. No.: 10/333,626

(22) PCT Filed: Jul. 12, 2001

(86) PCT No.: PCT/EP01/08079

§ 371 (c)(1),
(2), (4) Date: Jan. 23, 2003

(87) PCT Pub. No.: WO02/08577

PCT Pub. Date: Jan. 31, 2002

(65) Prior Publication Data

US 2004/0025510 A1 Feb. 12, 2004

(30) Foreign Application Priority Data

Jul. 25, 2000 (EP) ..... 00115909

(51) Int. Cl.[7] ..... F02C 6/18

(52) U.S. Cl. ..... 60/772; 60/39.182

(58) Field of Search ..... 60/772, 39.182, 60/667; 122/7 R

(56) References Cited

U.S. PATENT DOCUMENTS

| | | | | | |
|---|---|---|---|---|---|
| 3,756,023 | A | * | 9/1973 | Berman | 60/667 |
| 4,799,461 | A | * | 1/1989 | Shigenaka et al. | 122/7 R |
| 5,044,163 | A | * | 9/1991 | Bruckner et al. | 60/39.182 |
| 5,369,950 | A | * | 12/1994 | Bruckner et al. | 60/39.182 |
| 5,661,968 | A | * | 9/1997 | Gabriel | 60/39.182 |
| 6,041,588 | A | * | 3/2000 | Bruckner et al. | 60/39.182 |
| 6,363,710 | B1 | * | 4/2002 | Gebke et al. | 60/39.182 |

FOREIGN PATENT DOCUMENTS

| | | |
|---|---|---|
| DE | 19512466 | 8/1996 |
| DE | 19736889 | 5/2001 |
| EP | 0281151 | 9/1988 |
| EP | 0309792 | 4/1989 |
| EP | 0523467 | 10/1993 |

* cited by examiner

*Primary Examiner*—Michael Koczo
(74) *Attorney, Agent, or Firm*—Harness, Dickey & Pierce, P.L.C.

(57) ABSTRACT

In a method operating a gas and steam turbine installation having a gas turbine which can be operated with both gas and oil, during a change of operation from gas to oil, a partial-flow mixture formed from a first partial flow of heated feedwater and from a second partial flow of comparatively cool feedwater is admixed directly with the cold condensate. Thus, this is done without a heat exchanger. To this end, the installation includes a feed line for the heated feedwater. The feed line is directed to the condensate preheater and includes an admixing point for feeding the comparatively cool feedwater.

24 Claims, 1 Drawing Sheet

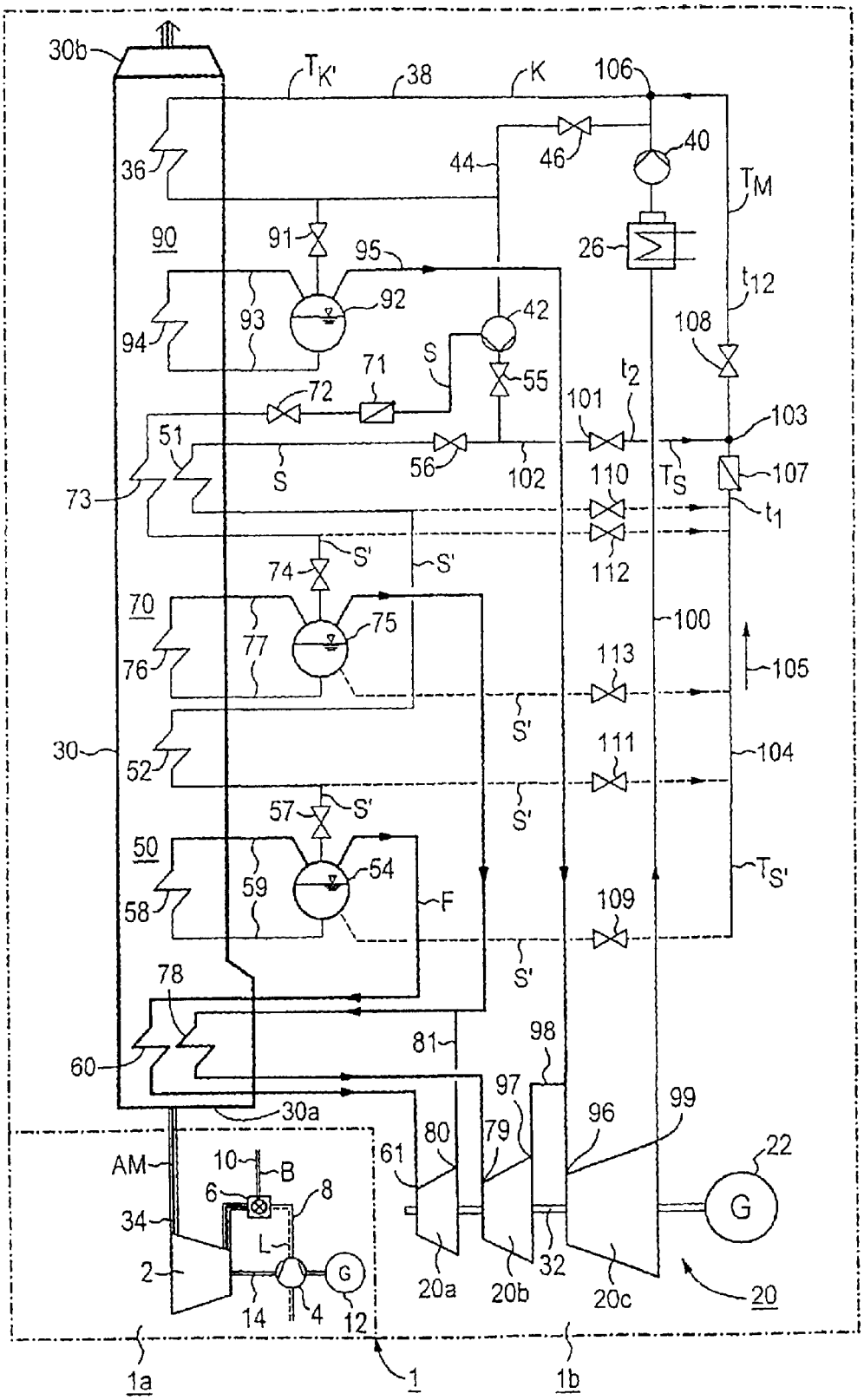
30b
$T_{K'}$
38
K
106
36
44
46
40
$T_M$
90
91
95
26
$t_{12}$
94
93
92
42
108
S
71
55
$t_2$
72
101
103
51
56
102
110
$T_S$
107
73
S
$t_1$
S'
S'
74
112
70
75
100
76
77
113
105
S'
30
52
111
104
57
S'
S'
50
54
$T_{S'}$
58
59
F
109
S'
78
81
98
60
97
99
30a
96
80
79
22
AM
10
B
61
6
8
34
L
G
2
14
4
12
20a
20b
32
20c
20
1a
1
1b

METHOD FOR OPERATING A GAS AND STREAM TURBINE INSTALLATION AND CORRESPONDING INSTALLATION

This application is the national phase under 35 U.S.C. § 371 of PCT International Application No. PCT/EP01/08079 which has an International filing date of Jul. 12, 2001, which designated the United States of America and which claims priority on German Patent Application number EP 00115909.4 filed Jul. 25, 2000, the entire contents of which are hereby incorporated herein by reference.

FIELD OF THE INVENTION

The invention generally relates to a method of operating a gas- and steam-turbine installation. Preferably, in the method the flue gas discharging from a gas turbine which can be operated with both gas and oil is directed via a heat-recovery steam generator. The heating surfaces of the generator are preferably connected in a water/steam circuit of a steam turbine having a number of pressure stages, with condensate preheated in the heat-recovery steam generator being heated as feedwater, under high pressure compared with the condensate, and being fed as steam to the steam turbine.

BACKGROUND OF THE INVENTION

In a gas- and steam-turbine installation, the heat contained in the expanded working medium or flue gas from the gas turbine is utilized for generating steam for the steam turbine connected in a water/steam circuit. In this case, the heat transfer is effected in a heat-recovery steam generator or boiler which is connected downstream of the gas turbine and in which heating surfaces are arranged in the form of tubes or tube bundles. The latter in turn are connected in the water/steam circuit of the steam turbine.

The water/steam circuit in this case normally comprises a plurality of pressure stages, for example two or three pressure stages, a preheater and an evaporator and also a superheater being provided as heating surfaces in each pressure stage. EP 0 523 467 B1, for example, discloses such a gas- and steam-turbine installation.

In this case, the total water quantity directed in the water/steam circuit is proportioned in such a way that the flue gas leaving the heat-recovery steam generator, as a result of the heat transfer, is cooled down to a temperature of about 70° C. to 100° C. Thus, in particular, the heating surfaces exposed to the hot flue gas and pressure drums provided for a water/steam separation are designed for full-load or rated operation, at which an efficiency of currently about 55% to 60% is achieved.

For thermodynamic reasons, it is also desired in this case that the temperatures of the feedwater, which is directed in the heating surfaces and is under varying pressure, are as close as possible to the temperature profile of the flue gas cooling down along the heat-recovery steam generator as a result of the heat exchange. The aim here is to keep the temperature difference between the feedwater directed via the individual heating surfaces and the flue gas as small as possible in each region of the heat-recovery steam generator. Thus, as high a proportion as possible, of the heat quantity contained in the flue gas, is transformed in the process. A condensate preheater for heating condensed water from the steam turbine is additionally provided in the heat-recovery steam generator.

The gas turbine of such a gas- and steam-turbine installation may be designed for operation with various fuels. If the gas turbine is designed for fuel oil and for natural gas, fuel oil, as fuel for the gas turbine, is only provided for a short operating period, for example for 100 to 500 h/a, as "backup" for the natural gas. The priority in this case is normally to design and optimize the gas- and steam-turbine installation for natural-gas operation of the gas turbine. As such, a sufficiently high inlet temperature of the condensate flowing into the heat-recovery steam generator is then ensured during fuel-oil operation. In particular, during a change from gas operation to oil operation, the necessary heat can be extracted from the heat-recovery steam generator itself in various ways. One possibility is to bypass the condensate preheater entirely or partly and to heat the condensate in a feedwater tank, connected in the watert-steam circuit, by feeding low-pressure steam. However, such a method, at low steam pressures, requires a large-volume and possibly multi-stage heating-steam system in the feedwater tank, a factor which, during long heating intervals, may put at risk deaeration normally taking place in the feedwater tank.

In order in particular to ensure effective deaeration, the condensate temperature in the feedwater tank is normally kept within a temperature range of between 130° C. and 160° C. In this case, preheating of the condensate via a preheater fed with low-pressure steam or hot water from an economizer is provided as a rule, so that the heating interval of the condensate in the feedwater tank is kept as small as possible. In this case, in particular in dual- or triple-pressure installations, hot-water extraction from the high-pressure economizer is necessary in order to provide sufficient heat. However, this has the considerable disadvantage, in particular in triple-pressure installations or circuits, that an external, additional condensate preheater, which has to be designed for the high pressures and high temperatures or high temperature differences, is required. This method is therefore already extremely undesirable on account of the considerable costs and the additional space required for the condensate preheater.

It is also possible, during oil operation of the gas turbine, to carry out or assist the condensate heating in the feedwater tank or in the de-aerator with a partial flow from a reheater. However, this method also cannot be used in particular in modern installation circuits without a feedwater tank and without a de-aerator, especially as there are no devices or apparatus for mixed preheating.

DE 197 36 889 C1 has certainly disclosed a method which, compared with the methods described, can be carried out with little outlay in terms of apparatus and operation and which is based on a displacement of the exhaust-gas heat in the direction of the condensate preheating as a result of a reduction in the low-pressure range and on an installation of economizer bypasses on the water side. However, there are also limits to the implementation of this method with certain requirements.

SUMMARY OF THE INVENTION

An object of an embodiment of the invention is to specify a method of operating a gas- and steam-turbine installation, which method, with at the same time little outlay in terms of apparatus and operation, in an effective manner which is favorable with regard to the efficiency, ensures a change from gas operation to oil operation of the gas turbine while covering a wide temperature range of the inlet temperature of the condensate flowing into the heat-recovery steam generator. Furthermore, a gas- and steam-turbine installation which is especially suitable for carrying out the method is to be specified.

With regard to the method, an object may be achieved according to an embodiment of the invention. To this end, provision is made for feedwater which is under high pressure compared with the condensate and has a high temperature compared with the condensate to be expediently admixed with the cold condensate without a heat exchanger and thus directly via an additional pipeline. The heated feedwater or hot water is extracted as a first partial flow from a high-pressure drum in the case of dual-pressure system, i.e. in the case of a dual-pressure installation, and from the high-pressure drum and/or from an intermediate-pressure drum in the case of a triple-pressure system or triple-pressure installation. Alternatively, the first partial flow may also be extracted at the outlet of the high-pressure economizer or the intermediate-pressure economizer.

If and when required, the pressure of the low-pressure system may be additionally increased in order to displace heat contained in the flue gas from the low-pressure system toward the condensate preheater arranged downstream of the latter on the flue-gas side. It is essential in this case that the heated feedwater, which is extracted from the water/steam circuit at a suitable point and is in the form of a partial-flow mixture of feedwater partial flows of different temperature, is admixed with the cold condensate without prior heating, i.e. without heat exchange in an additional heat exchanger.

In this case, an embodiment of the invention may be based on the idea that an additional heat exchanger which cools the heated feedwater or heating water, extracted from the water/steam circuit, to the temperature level of the condensate system before its pressure is reduced, in order to thereby prevent the generation of steam following the pressure reduction can be dispensed with if a partial flow of feedwater having a likewise high pressure but a comparatively low temperature is admixed with the heated feedwater before its pressure is reduced such that the mixing temperature which occurs is below the boiling temperature in the condensate system.

In this case, in particular in a triple-pressure system, heated feedwater can be extracted from the intermediate-pressure system, from the high-pressure system or from both systems. The extraction here depends essentially on the heat required for heating the condensate and also on which installation efficiency is to be at least maintained during oil operation, serving only as backup, of the gas turbine.

With regard to the installation, the object may be so that the partial-flow mixture formed from the first partial flow of heated feedwater and from the second partial flow of comparatively cool feedwater is admixed with the cold condensate directly and thus without a heat exchanger during a change of operation from gas to oil. The installation comprises a feed line for the heated feedwater, this feed line being directed to the condensate preheater and having an admixing point for feeding the comparatively cool feedwater.

The advantages achieved with embodiments of the invention include, in particular, the fact that a water inlet temperature which is required during oil operation of the gas turbine and is increased compared with the gas operation of the gas turbine, can be set in the heat-recovery steam generator especially simpley, even without an additional heat exchanger or external condensate preheater. It is done by heated feedwater which is set to a suitable mixing temperature and is under high pressure being admixed with the cold condensate directly, i.e. without a heat exchanger.

In this case, by the provision of a partial-flow mixture from two feedwater partial flows of different temperature, a mixing temperature of the partial-flow mixture admixed directly with the cold condensate during oil operation can be produced in an especially simple and effective manner. The mixing temperature is below the boiling temperature of the preheated condensate or of the condensate to be preheated. In addition, since the rate of flow in the condensate preheater correspondingly increases via the returned feedwater, condensate circulating pumps hitherto necessary may be dispensed with. In particular, it is possible to cover a wide temperature range of the inlet temperature of the steam generator or boiler without circuit modification.

It can be seen that the capacity reserves of the high-pressure feedwater pump can also be utilized in this way. This can occur since, during oil operation as compared with gas operation, on account of a lower gas-turbine output, lower delivery quantities are normally also required. Standardization is also possible on account of the operating range expanded in terms of the circuit in an especially effective manner. Furthermore, the investment costs are especially low.

On account of the comparatively less complex controls and changeovers, a comparatively simple mode of operation is achieved on the one hand. Further, comparatively high reliability is also achieved, since components which are less active overall are required. On account of the comparatively small number of components, the maintenance cost is reduced and fewer spare parts are required to be held in stock.

BRIEF DESCRIPTION OF THE DRAWINGS

An exemplary embodiment of the invention is explained in more detail below with reference to a drawing. In the drawing, the FIGURE schematically shows a gas- and steam-turbine installation designed for a change of operation from gas to oil.

DETAILED DESCRIPTION OF THE PREFERRED EMBODIMENTS

The gas- and steam-turbine installation 1 according to the FIGURE includes a gas-turbine installation 1*a* and a steam-turbine installation 1*b*. The gas-turbine installation 1*a* includes a gas turbine 2 with coupled air compressor 4 and a combustion chamber 6 which is connected upstream of the gas turbine 2 and is connected to a fresh-air line 8 of the air compressor 4. Opening into the combustion chamber 6 is a fuel line 10, via which gas or oil, as fuel B, can be fed alternatively to the combustion chamber 6. The fuel B is burned with the feeding of compressed air L to form working medium or fuel gas for the gas turbine 2. The gas turbine 2 and the air compressor 4 and also a generator 12 sit on a common turbine shaft 14.

The steam-turbine installation 1*b* includes a steam turbine 20 with coupled generator 22 and, in a water/steam circuit 24, a condenser 26 connected downstream of the steam turbine 20 and also a heat-recovery steam generator 30. The steam turbine 20 has a first pressure stage or a high-pressure part 20*a* and a second pressure stage or an intermediate-pressure part 20*b*, and also a third pressure stage or a low-pressure part 20*c*, which drive the generator 22 via a common turbine shaft 32.

To feed working medium or flue gas AM, expanded in the gas turbine 2, into the heat-recovery steam generator 30, an exhaust-gas line 34 is connected to an inlet 30*a* of the heat-recovery steam generator 30. The flue gas AM from the gas turbine 2, which flue gas AM is cooled down along the heat-recovery steam generator 30 as a result of indirect heat exchange with condensate K and feedwater S directed in the water/steam circuit 24, leaves the heat-recovery steam generator 30 via its outlet 30*b* in the direction of a stack (not shown).

The heat-recovery steam generator 30 includes, as heating surfaces, a condensate preheater 36, which is fed with condensate K from the condenser 26 on the inlet side via a condensate line 38 in which a condensate pump 40 is connected. The condensate preheater 36 is directed on the outlet side to the suction side of a feedwater pump 42. To bypass the preheater 36 if and when required, it is bridged with a bypass line 44, in which a valve 46 is connected.

The feedwater pump 42 is designed as a high-pressure feedwater pump with intermediate-pressure extraction. It brings the condensate K to a pressure level of about 120 bar to 150 bar, this pressure level being suitable for a high-pressure stage 50, assigned to the high-pressure part 20*a* of the steam turbine 20, of the water/steam circuit 24. Via the intermediate-pressure extraction, the condensate K is brought to a pressure level of about 40 bar to 60 bar, this pressure level being suitable for an intermediate-pressure stage 70 assigned to the intermediate-pressure part 20*b* of the steam turbine 20.

The condensate K which is conducted via the feedwater pump 42 and is designated as feedwater S on the pressure side of the feedwater pump 42 is partly fed at high pressure to a first high-pressure economizer 51 or feedwater preheater and via the latter to a second high-pressure economizer 52. The latter is connected on the outlet side to a high-pressure drum 54 via a valve 57.

In addition, the feedwater S is partly fed at intermediate pressure to a feedwater preheater or intermediate-pressure economizer 73 via a check valve 71 and a valve 72 connected downstream of the latter. The intermediate-pressure economizer 73 is connected on the outlet side to an intermediate-pressure drum 75 via a valve 74. Similarly, as part of a low-pressure stage 90, assigned to the low-pressure part 20*c* of the steam turbine 20, of the water/steam circuit 24, the condensate preheater 36 is connected on the outlet side to a low-pressure drum 92 via a valve 91.

The intermediate-pressure drum 75 is connected to an intermediate-pressure evaporator 76 arranged in the heat-recovery steam generator 30 for forming a water-steam circulation 77. Arranged on the steam side on the intermediate-pressure drum 75 is a reheater 78. The reheater 78 is directed on the outlet side (hot reheating) to an inlet 79 of the intermediate-pressure part 20*b*. Into the reheater 78, an exhaust-steam line 81 connected to an outlet 80 of the high-pressure part 20*a* of the steam turbine 20 is directed on the inlet side (cold reheating).

On the high-pressure side, the feedwater pump 42 is connected to the high-pressure drum 54 via two valves 55, 56 and via the first high-pressure economizer 51 and the second high-pressure economizer 52, connected downstream of the latter on the feedwater side and arranged upstream of the same in the heat-recovery steam generator 30 on the flue-gas side, and also via a further valve 57, provided if and when required. The high-pressure drum 54 is in turn connected to a high-pressure evaporator 58 arranged in the heat-recovery steam generator 30 for forming a water/steam circulation 59. To draw off live steam F, the high-pressure drum 54 is connected to a high-pressure superheater 60 which is arranged in the heat-recovery steam generator 30 and is connected on the outlet side to an inlet 61 of the high-pressure part 20*a* of the steam turbine 20.

The high-pressure economizers 51, 52 and the high-pressure evaporator 58 and also the high-pressure superheater 59 together with the high-pressure part 20*a* form the high-pressure stage 50 of the water/steam circuit 24. The intermediate-pressure evaporator 76 and the reheater 78 together with the intermediate-pressure part 20*b* form the intermediate-pressure stage 70 of the water/steam circuit 24. Similarly, a low-pressure evaporator 94 arranged in the heat-recovery steam generator 30 and connected to the low-pressure drum 94 for forming a water/steam circulation 93 forms, together with the low-pressure part 20*c* of the steam turbine 20, the low-pressure stage 90 of the water/steam circuit 24. To this end, the low-pressure drum 92 is connected on the steam side to an inlet 96 of the low-pressure part 20*c* via a steam line 95. An overflow line 98 connected to an outlet 97 of the intermediate-pressure part 20*b* opens into the steam line 95. An outlet 99 of the low-pressure part 20*c* is connected to the condenser 26 via a steam line 100.

The gas turbine 2 of the gas- and steam-turbine installation 1 can be operated with both natural gas and fuel oil as fuel B. During gas operation of the gas turbine 2, the working medium or flue gas AM fed to the heat-recovery steam generator 30 has comparatively high purity, the water/steam circuit 24 and the installation components being designed for this operating state and being optimized with regard to its efficiency. A valve 101 which lies in a partial-flow line 102 connected to the pressure side of the feedwater pump 42 via the valve 55 is closed in this operating state.

During the change from gas operation to oil operation of the gas turbine 2, the valve 101 is opened. The partial-flow line 102 is connected to an admixing point 103 of a feed line 104 which is connected on the outflow side in the flow direction 105 to the condensate line 38 via a mixing point 106. In the flow direction 105, a check valve 107 lies in the feed line 104 upstream of the admixing point 103 and a valve 108 lies in the feed line 104 downstream of the admixing point 103.

With the opening, or following the opening, of the valve 101 during oil operation of the gas turbine 2, an adjustable first partial flow $t_1$ of heated feedwater S' is directed into the admixing line 104. This feedwater S' is extracted preferably from the water side of the high-pressure drum 54 via a valve 109. Alternatively, the heated feedwater S', as adjustable first partial flow $t_1$, may also be extracted from the outlet side of the first high-pressure economizer 51 via a valve 110 or from the outlet side of the second high-pressure economizer 52 via a valve 111.

Alternatively or additionally, in the triple-pressure system shown, heated feedwater S', as adjustable first partial flow $t_1$, may also be extracted from the outlet side of the intermediate-pressure economizer 73 via a valve 112 or from the water side of the intermediate-pressure drum 75 via a valve 113.

A second partial flow $t_2$ of comparatively cool feedwater S is admixed with the first partial flow $t_1$ of heated feedwater S' at the admixing point 103. The second partial flow $t_2$ directed via the partial-flow line 102 can be adjusted by means of the valve 101. The partial-flow mixture $t_{1,2}$ formed in the process is admixed with the cold condensate K via the mixing point 106. In this case, the temperature $T_{S'}$ of the first partial flow $t_1$ during its extraction as heated feedwater S' from the high-pressure drum 54 is, for example, 320° C.

At a temperature $T_S$ of the second partial flow $t_2$ as comparatively cool feedwater S of, for example, 150° C., a mixing temperature $T_M$ of the partial-flow mixture $t_{1,2}$ of about 210° C. is obtained by appropriate setting of the quantities of the two partial flows $t_1$ and $t_2$ by means of the valves 109 to 112 and 101, respectively. The mixing of the two partial flows $t_1$ and $t_2$ of different feedwater temperatures $T_{S'}$ and $T_S$, respectively, ensures that the heated feedwater or heating water S' extracted from the water/steam circuit 54, before its pressure is reduced when being introduced via the mixing point 106 into the condensate line 38, is cooled to the temperature level of the condensate system and thus to below 200° C. As a result, the generation of steam following the pressure reduction is prevented, the valve 108 serving to reduce the pressure of the partial-flow mixture $t_{1,2}$.

Due to fact that the partial-flow mixture $t_{1,2}$ formed from the two feedwater partial flows $t_1$ and $t_2$ of different temperatures $T_{S'}$, $T_S$ is admixed directly with the cold condensate K, i.e. without a heat exchanger, a water- or boiler-inlet temperature $T_K$, of, for example, 120 to 130° C., which is required during oil operation of the gas turbine 2 and is increased compared with gas operation, can be set with an especially simple device, and in particular without the interposition of an additional heat exchanger.

List of designations

| | |
|---|---|
| 1 | Gas- and steam-turbine installation |
| 1a | Gas-turbine installation |
| 1b | Steam-turbine installation |
| 2 | Gas turbine |
| 4 | Air compressor |
| 6 | Combustion chamber |
| 8 | Fresh-air line |
| 10 | Fuel line |
| 12 | Generator |
| 14 | Turbine shaft |
| 20 | Steam turbine |
| 20a | High-pressure part |
| 20b | Intermediate-pressure part |
| 20c | Low-pressure part |
| 22 | Generator |
| 24 | Water/steam circuit |
| 26 | Condenser |
| 30 | Heat-recovery steam generator |
| 30a | Inlet |
| 30b | Outlet |
| 32 | Turbine shaft |
| 34 | Exhaust-gas line |
| 36 | Condensate preheater |
| 38 | Condensate line |
| 40 | Condensate pump |
| 42 | Feedwater pump |
| 44 | Bypass line |
| 46 | Valve |
| 50 | High-pressure stage |
| 51, 52 | HP economizer |
| 53 | Valve |
| 54 | HP drum |
| 55–57 | Valve |
| 58 | HP evaporator |
| 59 | Circulation |
| 60 | HP superheater |
| 61 | Inlet |
| 70 | Intermediate-pressure stage |
| 71 | Check valve |
| 72 | Valve |
| 73 | IP economizer |
| 74 | Valve |
| 75 | IP drum |
| 76 | IP evaporator |
| 77 | Circulation |
| 78 | Reheater |
| 79 | Inlet |
| 80 | Outlet |
| 81 | Steam line |
| 90 | Low-pressure stage |
| 91 | Valve |
| 92 | LP drum |

-continued

| | |
|---|---|
| 93 | Circulation |
| 94 | LP evaporator |
| 95 | Steam line |
| 96 | Inlet |
| 97 | Outlet |
| 98 | Overflow line |
| 99 | Outlet |
| 100 | Steam line |
| 101 | Valve |
| 102 | Partial-flow line |
| 103 | Admixing point |
| 104 | Inflow line |
| 105 | Flow direction |
| 106 | Mixing point |
| 107 | Check valve |
| 108–113 | Valve |
| AM | Flue gas |
| B | Fuel |
| K | Condensate |
| L | Air |
| S | Feedwater |
| S' | Hot water |
| $t_1$ | First partial flow |
| $t_2$ | Second partial flow |
| $t_{1,2}$ | Partial-flow mixture |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of operating a gas- and steam-turbine installation, comprising:

directing flue gas discharging from a gas turbine, operatable with both gas and oil, via a heat-recovery steam generator, wherein heating surfaces of the heat-recovery steam generator are connected in a water/steam circuit of a steam turbine having a plurality of pressure stages;

heating condensate as feedwater, preheated in the heat-recovery steam generator, under relatively high pressure compared with the condensate; and feeding the feedwater as steam to the steam turbine, wherein, during a change of operation from gas to oil, a partial-flow mixture formed from a first partial flow of heated feedwater and from a second partial flow of comparatively cool feedwater is admixed directly with the cold condensate.

2. The method as claimed in claim 1, wherein the second partial flow, admixed with the first partial flow before its pressure is reduced to the pressure level of the condensate, is adjusted in such a way that the temperature of the partial-flow mixture is below the boiling temperature of the condensate to be preheated.

3. The method as claimed in claim 1, wherein the first partial flow is extracted from at least one of a high-pressure stage and an intermediate-pressure stage of the water/steam circuit.

4. The method as claimed in claim 1, wherein the first partial flow is extracted from the outlet side of at least one of a high-pressure economizer and intermediate-pressure economizer provided as heating surface in the heat-recovery steam generator.

5. The method as claimed in claim 1, wherein the first partial flow is extracted from at least one of a high-pressure drum and intermediate-pressure drum connected in the water/steam circuit.

6. The method as claimed in claim 2, wherein the first partial flow is extracted from at least one of a high-pressure stage and an intermediate-pressure stage of the water/steam circuit.

7. The method as claimed in claim 2, wherein the first partial flow is extracted from the outlet side of at least one of a high-pressure economizer and intermediate-pressure economizer provided as heating surface in the heat-recovery steam generator.

8. The method as claimed in claim 3, wherein the first partial flow is extracted from the outlet side of at least one of a high-pressure economizer and intermediate-pressure economizer provided as heating surface in the heat-recovery steam generator.

9. The method as claimed in claim 2, wherein the first partial flow is extracted from at least one of a high-pressure drum and intermediate-pressure drum connected in the water/steam circuit.

10. The method as claimed in claim 3, wherein the first partial flow is extracted from at least one of a high-pressure drum and intermediate-pressure drum connected in the water/steam circuit.

11. The method as claimed in claim 4, wherein the first partial flow is extracted from at least one of a high-pressure drum and intermediate-pressure drum connected in the water/steam circuit.

12. A gas and steam turbine installation, comprising:

a gas turbine, operatable with both gas and oil;

a heat-recovery steam generator, connected downstream of the gas turbine on the exhaust-gas side, wherein heating surfaces of the heat-recovery steam generator are connected in a water/steam circuit of a steam turbine comprising at least one low-pressure stage and one high-pressure stage; and a feed line, which on an outflow side is directed to the inlet side of a condensate preheater arranged as a heating surface in the heat-recovery steam generator, has an admixing point and on an inflow side is directed to a water side of a pressure drum connected in at least one of the water/steam circuit and to the outlet side of an economizer arranged as heating surface in the heat-recovery steam generator, wherein an adjustable second partial flow of comparatively cool feedwater is feedable via the admixing point to a first partial flow of heated feedwater, the first partial flow being extracted from at lest one of the pressure drum and the economizer and being directed via the feed line.

13. The gas and steam turbine installation as claimed in claim 12, wherein, in the flow direction of the partial-flow mixture formed from the first partial flow and from the second partial flow, a valve for reducing the pressure of at least one of the first partial flow and the partial-flow mixture is connected in the feed line downstream of the admixing point.

14. The gas and steam turbine installation as claimed in claim 12, wherein, to adjust the first partial flow, at least one valve is connected in the feed line upstream of the admixing point in the flow direction of the first partial flow.

15. The gas and steam turbine installation as claimed in claim 12, further comprising a partial-flow line, which on the outlet side opens into the admixing point and on the inlet side is connected to the pressure side of a feedwater pump.

16. The gas and steam turbine installation as claimed in claim 15, wherein a valve for adjusting the second partial flow is connected in the partial-flow line.

17. The gas and steam turbine installation as claimed in claim 13, wherein, to adjust the first partial flow, at least one valve is connected in the feed line upstream of the admixing point in the flow direction of the first partial flow.

18. The gas and steam turbine installation as claimed in claim 13, further comprising a partial-flow line, which on the outlet side opens into the admixing point and on the inlet side is connected to the pressure side of a feedwater pump.

19. The gas and steam turbine installation as claimed in claim 14, further comprising a partial-flow line, which on the outlet side opens into the admixing point and on the inlet side is connected to the pressure side of a feedwater pump.

20. A method operating a turbine installation, having a gas turbine operable with both gas and oil, comprising:

heating condensate as feedwater, under relatively high pressure compared with the condensate;

admixing a partial-flow mixture during a change of operation from gas to oil, formed from a first partial flow of the heated feedwater and from a second partial flow of comparatively cool feedwater, directly with cold condensate; and feeding the feedwater as steam to a steam turbine.

21. The method as claimed in claim 20, wherein the second partial flow, admixed with the first partial flow before its pressure is reduced to the pressure level of the condensate, is adjusted such that the temperature of the partial-flow mixture is below the boiling temperature of the condensate to be preheated.

22. The method as claimed in claim 20, wherein the first partial flow is extracted from at least one of a high-pressure stage and an intermediate-pressure stage of a water/steam circuit.

23. The method as claimed in claim 20, wherein the first partial flow is extracted from an outlet side of at least one of a high-pressure economizer and intermediate-pressure economizer provided as heating surface in the heat-recovery steam generator.

24. The method as claimed in claim 20, wherein the first partial flow is extracted from at least one of a high-pressure drum and intermediate-pressure drum connected in a water/steam circuit.

* * * * *